US011225875B1

(12) United States Patent
Madonna et al.

(10) Patent No.: US 11,225,875 B1
(45) Date of Patent: Jan. 18, 2022

(54) RAIL SUPPORT BEAMS

(71) Applicant: Raytheon Technologies Corporation, Farmington, CT (US)

(72) Inventors: Nicholas J. Madonna, North Haven, CT (US); Kristopher K. Anderson, Somers, CT (US); Justin M. Aniello, Ellington, CT (US); Jeffrey Michael Jacques, East Hartford, CT (US); Daniel P. Preuss, Newington, CT (US); Christina A. Ryan, Manchester, CT (US); Melissa Shallcross, Middletown, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/159,857

(22) Filed: Jan. 27, 2021

(51) Int. Cl.

| | |
|---|---|
| ***F01D 9/02*** | (2006.01) |
| ***F01D 5/20*** | (2006.01) |
| ***F01D 5/30*** | (2006.01) |
| ***F01D 5/14*** | (2006.01) |

(52) U.S. Cl.
CPC ..... *F01D 5/20* (2013.01); *F01D 5/147* (2013.01); *F01D 5/3061* (2013.01); *F01D 9/02* (2013.01)

(58) Field of Classification Search
CPC ..... F01D 5/20; F01D 5/147; F01D 5/3061; F01D 9/00; F01D 9/02; F01D 9/041; F05D 2240/80
See application file for complete search history.

(56) References Cited

U.S. PATENT DOCUMENTS

| | | | | |
|---|---|---|---|---|
| 3,365,173 | A | 1/1968 | Lynch et al. | |
| 5,822,975 | A * | 10/1998 | Guyonnet | F01D 5/022 60/226.1 |
| 6,135,711 | A * | 10/2000 | Binder | F01D 5/147 415/209.3 |
| 6,558,115 | B2 | 5/2003 | Tiemann | |
| 8,939,717 | B1 * | 1/2015 | Lee | F01D 25/246 415/182.1 |
| 9,500,088 | B2 | 11/2016 | Schlemmer et al. | |
| 10,301,951 | B2 * | 5/2019 | Bergman | F02C 3/04 |

FOREIGN PATENT DOCUMENTS

WO 2005008032 A1 1/2005

* cited by examiner

*Primary Examiner* — Eldon T Brockman
(74) *Attorney, Agent, or Firm* — Cantor Colburn LLP

(57) ABSTRACT

Vane assemblies are described. The vane assemblies include a platform, an airfoil extending from the platform, a forward rail extending from the platform and arranged along a forward side of the platform, and an aft rail extending from the platform and arranged along an aft side of the platform. At least one support beam is provided extending in a forward-aft direction between the forward rail and the aft rail and separated from the platform by a first distance. The at least one support beam has a thickness in a radial direction of 40% or less of a total radial extent from the platform to an outer diameter edge of at least one of the forward rail and the aft rail and the at least one support beam has a thickness in a circumferential direction of 30% or less of a total circumferential extent of vane assembly.

20 Claims, 7 Drawing Sheets

RAIL SUPPORT BEAMS

BACKGROUND

Exemplary embodiments of the present disclosure pertain to the art of gas turbine engines, and more particularly to platforms and rails of vanes of gas turbine engines.

A gas turbine engine typically includes a fan section, a compressor section, a combustor section, and a turbine section. Air entering the compressor section is compressed and delivered into the combustion section where it is mixed with fuel and ignited to generate a high-energy exhaust gas flow. The high-energy exhaust gas flow expands through the turbine section to drive the compressor and the fan section.

Components in the path of the high-energy gas flow through the turbine section experience high temperatures and pressures. The gas path through the turbine section is typically defined by blade outer air seals proximate a rotating airfoil and static vane stages. Cooling air is supplied to components exposed to the high-energy gas flow. Seals are provided between the blade outer air seals and platforms of the vane stages to contain the cooling air and prevent leakage into the gas path. Seals that are not seated properly or fail to accommodate relative movement between components may enable some cooling air to escape into the gas path and reduce engine efficiency. Moreover, poor sealing can enable high-energy gas flow to leak past the seals, thereby further affecting engine efficiency. Further, deflections of rails of platforms for vanes may compromise structural capability and overall life of the components.

BRIEF DESCRIPTION

In accordance with some embodiments of the present disclosure, vane assemblies are provided. The vane assemblies include a platform, an airfoil extending from a first side of the platform, a forward rail extending from a second side of the platform and arranged along a forward side of the platform, and an aft rail extending from the second side of the platform and arranged along an aft side of the platform. At least one support beam is provided extending in a forward-aft direction between the forward rail and the aft rail and separated from the platform by a first distance. The at least one support beam has a thickness in a radial direction of 40% or less of a total radial extent from the platform to an outer diameter edge of at least one of the forward rail and the aft rail. The at least one support beam has a thickness in a circumferential direction of 30% or less of a total circumferential extent of vane assembly.

In addition to one or more of the features described above, or as an alternative to any of the foregoing embodiments, the vane assemblies may include that the at least one support beam comprises a first support beam and a second support beam separated by a void in a direction between the first and second support beams.

In addition to one or more of the features described above, or as an alternative to any of the foregoing embodiments, the vane assemblies may include that the at least one support beam is formed from a material different from the forward rail and the aft rail.

In addition to one or more of the features described above, or as an alternative to any of the foregoing embodiments, the vane assemblies may include that the at least one support beam is formed from a material that is the same as that of the forward rail and the aft rail.

In addition to one or more of the features described above, or as an alternative to any of the foregoing embodiments, the vane assemblies may include that the at least one support beam is integrally formed with each of the forward rail and the aft rail.

In addition to one or more of the features described above, or as an alternative to any of the foregoing embodiments, the vane assemblies may include that the at least one support beam includes filleted surfaces at locations where the at least one support beam connects to at least one of the forward rail and the aft rail.

In addition to one or more of the features described above, or as an alternative to any of the foregoing embodiments, the vane assemblies may include that the at least one support beam is welded to each of the forward rail and the aft rail.

In addition to one or more of the features described above, or as an alternative to any of the foregoing embodiments, the vane assemblies may include that the at least one support beam is brazed to each of the forward rail and the aft rail.

In addition to one or more of the features described above, or as an alternative to any of the foregoing embodiments, the vane assemblies may include that the forward rail includes a forward hook configured to engage with a portion of a turbine case.

In addition to one or more of the features described above, or as an alternative to any of the foregoing embodiments, the vane assemblies may include that the at least one support beam comprises at least two support beams that occupy a combined thickness in the radial direction of 40% or less of the total radial extent from the platform to an outer diameter edge of at least one of the forward rail and the aft rail and a combined thickness in the circumferential direction of 30% or less of the total circumferential extent of vane assembly.

In accordance with some embodiments of the present disclosure, gas turbine engines are provided. The gas turbine engines include a turbine case and a vane assembly. The vane assembly includes a platform, an airfoil extending from a first side of the platform, a forward rail extending from a second side of the platform and arranged along a forward side of the platform, and an aft rail extending from the second side of the platform and arranged along an aft side of the platform. At least one support beam is provided extending in a forward-aft direction between the forward rail and the aft rail and separated from the platform by a first distance. The at least one support beam has a thickness in a radial direction of 40% or less of a total radial extent from the platform to an outer diameter edge of at least one of the forward rail and the aft rail. The at least one support beam has a thickness in a circumferential direction of 30% or less of a total circumferential extent of vane assembly.

In addition to one or more of the features described above, or as an alternative to any of the foregoing embodiments, the gas turbine engines may include that the at least one support beam comprises a first support beam and a second support beam separated by a void in a direction between the first and second support beams.

In addition to one or more of the features described above, or as an alternative to any of the foregoing embodiments, the gas turbine engines may include that the at least one support beam is formed from a material different from the forward rail and the aft rail.

In addition to one or more of the features described above, or as an alternative to any of the foregoing embodiments, the gas turbine engines may include that the at least one support beam is formed from a material that is the same as that of the forward rail and the aft rail.

In addition to one or more of the features described above, or as an alternative to any of the foregoing embodiments, the gas turbine engines may include that the at least one support beam is integrally formed with each of the forward rail and the aft rail.

In addition to one or more of the features described above, or as an alternative to any of the foregoing embodiments, the gas turbine engines may include that the at least one support beam includes filleted surfaces at locations where the at least one support beam connects to at least one of the forward rail and the aft rail.

In addition to one or more of the features described above, or as an alternative to any of the foregoing embodiments, the gas turbine engines may include that the at least one support beam is welded to each of the forward rail and the aft rail.

In addition to one or more of the features described above, or as an alternative to any of the foregoing embodiments, the gas turbine engines may include that the at least one support beam is brazed to each of the forward rail and the aft rail.

In addition to one or more of the features described above, or as an alternative to any of the foregoing embodiments, the gas turbine engines may include that the forward rail includes a forward hook configured to engage with a portion of the turbine case.

In addition to one or more of the features described above, or as an alternative to any of the foregoing embodiments, the gas turbine engines may include that the at least one support beam comprises at least two support beams that occupy a combined thickness in the radial direction of 40% or less of the total radial extent from the platform to an outer diameter edge of at least one of the forward rail and the aft rail and a combined thickness in the circumferential direction of 30% or less of the total circumferential extent of vane assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
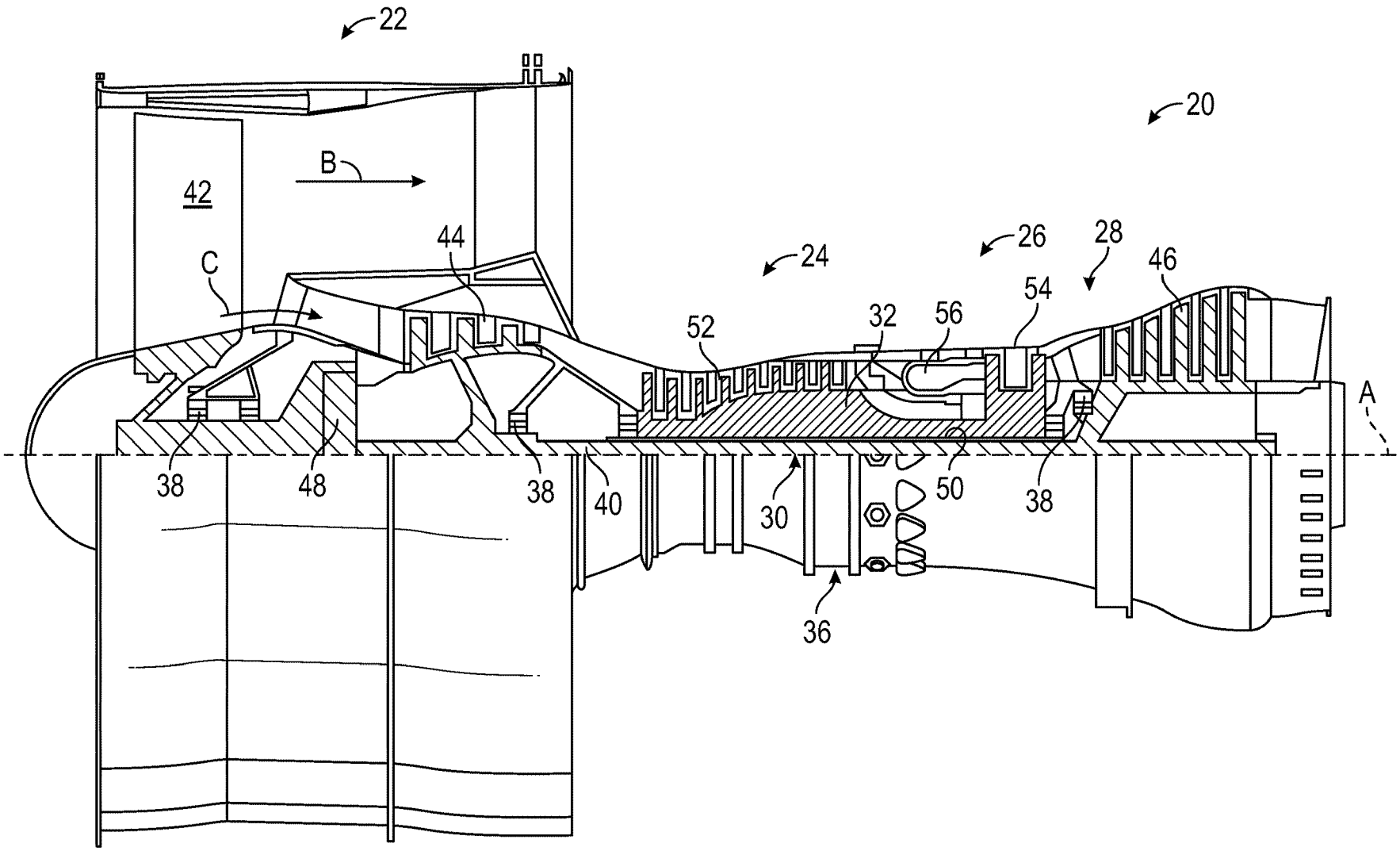
FIG. 1 is a partial cross-sectional view of a gas turbine engine that may incorporate embodiments of the present disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

For vanes within the compressor and/or turbine sections, forward and aft rails may be susceptible to large deflections due to height and loading conditions associated therewith. The large deflections can drive high steady stresses into certain areas of the part that compromise the structural capability and overall life metric of the vane assemblies. Embodiments of the present disclosure are directed to structural ties between the outer diameter forward and aft rails of vane platforms. The structural ties are provided in the form of support beams that mechanically connect the forward and aft rails at the outer diameter thereof. Although the rails tend to deflect toward each other under loading, the structural beams are provided to resist the deflections and prevent fatigue due to the deflections. A reduction in the deflections of the rails can reduce peak stresses in the part and can improve the structural capability and overall life metric of the vane assemblies.

Figure 2:
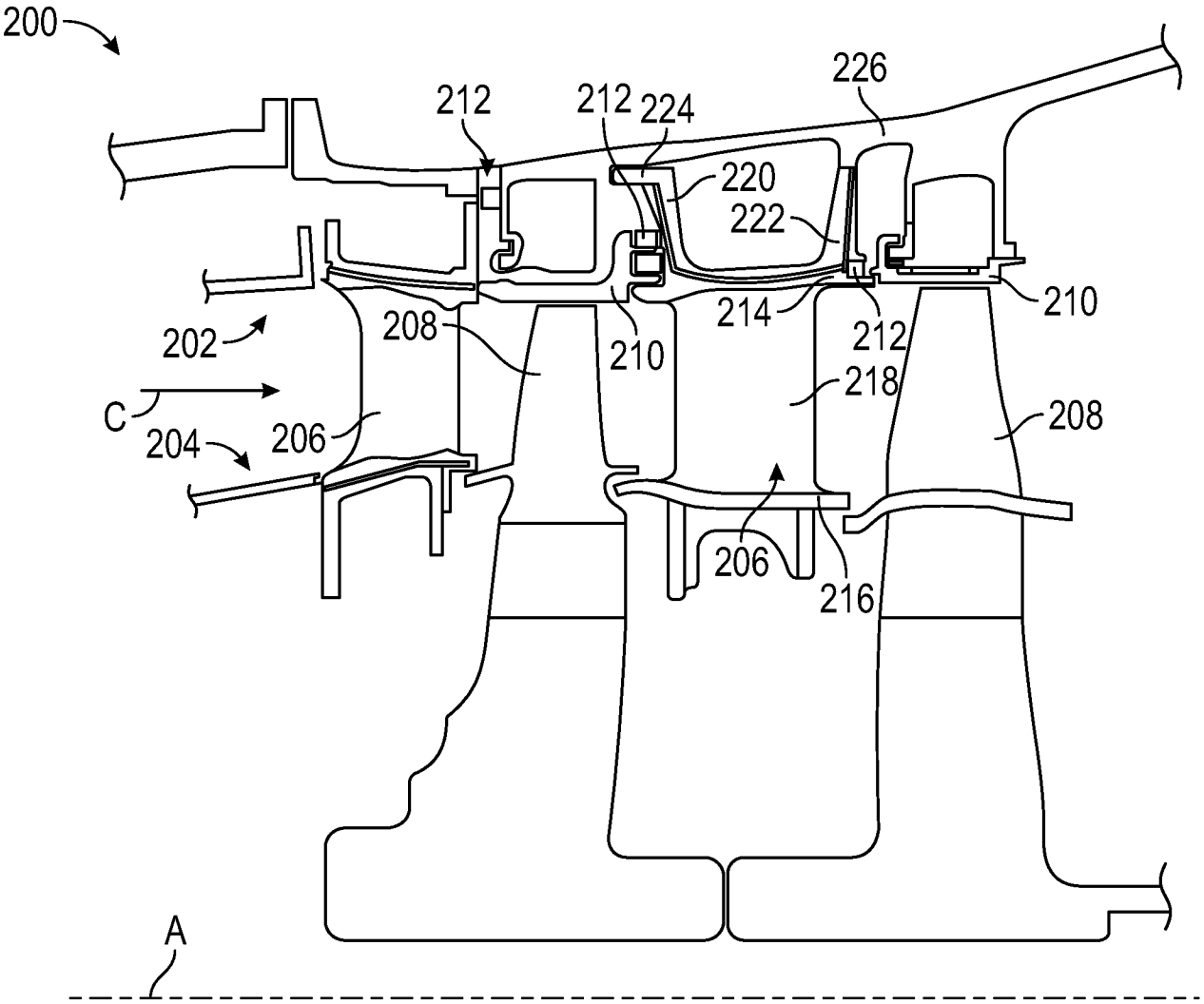
FIG. 2 is a cross section of a turbine section of a gas turbine engine that may incorporate embodiments of the present disclosure.

Referring to FIG. 2, a schematic illustration of a cross-section of a turbine section 200 of a gas turbine engine that may incorporate embodiments of the present disclosure is shown. A core flow path C flows through the turbine section 200. The core flow path C is defined with an outer gas path surface 202 and an inner gas path surface 204 that is defined along several adjacent components. In the illustrative example, the turbine section 200 and the gas path surfaces 202, 204 are defined by fixed turbine vanes 206 that are interspersed with turbine rotors 208 having blades that rotate about an engine central longitudinal axis A. A blade outer air seal (BOAS) 210 is disposed radially outward of each of the rotating airfoils (blades) of the turbine rotors 208 to define a portion of the outer gas path surface 204 of the core flow path C. Further, one or more seals 212 are provided between the fixed turbine vanes 206 and the BOAS 210.

As shown, the turbine vanes 206 include an outer diameter platform 214 and an inner diameter platform 216. An airfoil 218 extends between the platforms 214, 216 within the core flow path C. The outer diameter platform 214 includes a forward rail 220 and an aft rail 222. The forward rail 220 includes a hook 224 that engages a portion of a turbine case 226 to support the turbine vane 206. The rails 220, 222 may be subject to deflections, as described herein.

Figure 3:
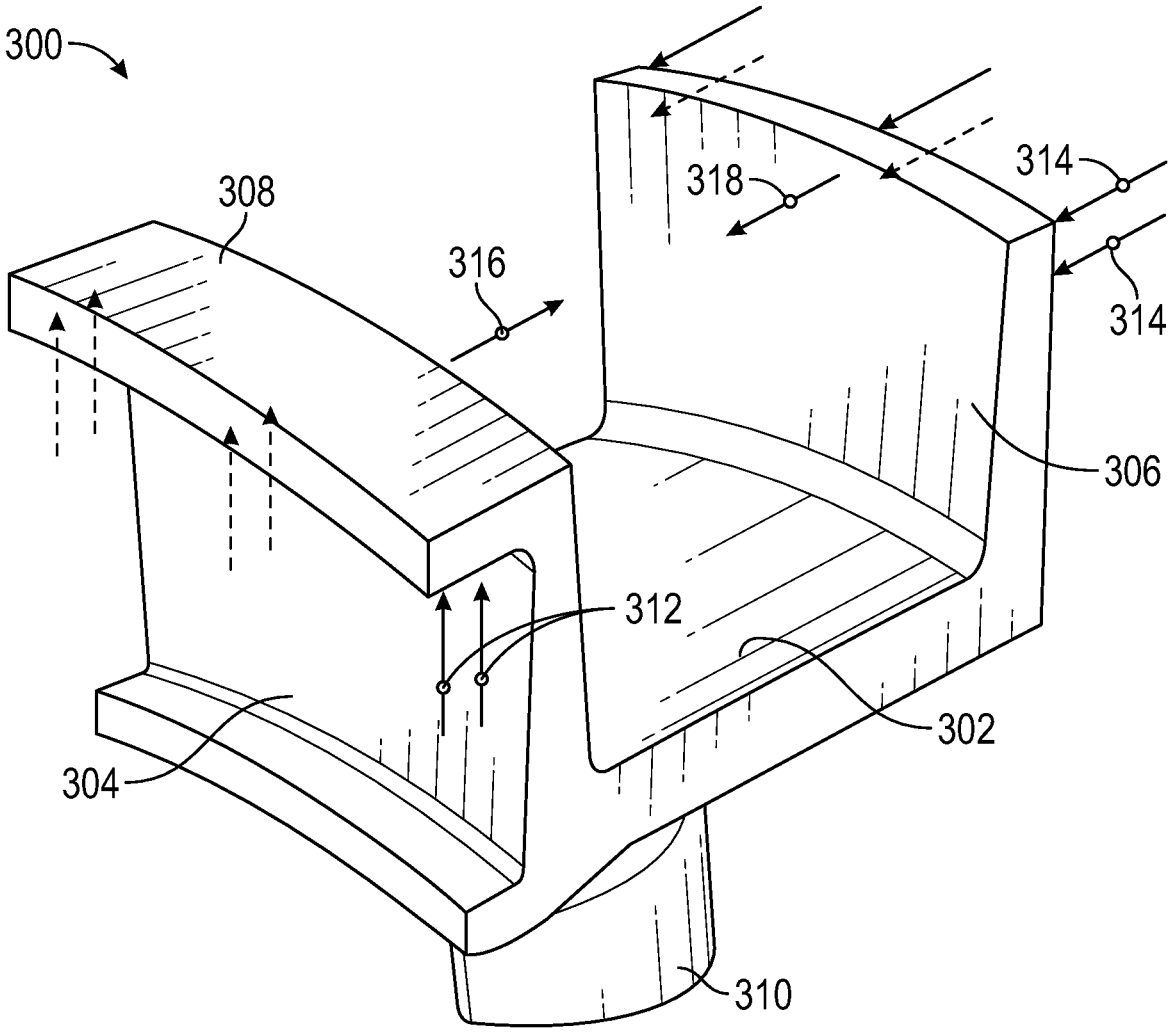
FIG. 3 is a schematic illustration of a vane assembly that may incorporate embodiments of the present disclosure.

For example, referring to FIG. 3, a schematic illustration of a vane assembly 300 is shown. FIG. 3 illustrates a conventional high pressure turbine vane outer diameter section of the vane assembly 300. The vane assembly 300 includes a platform 302 with a forward rail 304 and an aft rail 306. The forward rail 304 includes a forward hook 308 for engaging with a portion of a turbine case. An airfoil 310 extends radially inward from the platform 302. The vane assembly 300 is constrained in a radial direction via interfacing hardware that exposes the forward hook 308 to a forward distributed reaction force 312. The vane assembly 300 is constrained in the axial direction via interfacing hardware that exposes the aft rail 306 to an aft distributed reaction force 314. The forward distributed reaction force 312 causes the forward rail 304 to deflect in an aftward direction 316 and the aft distributed reaction force 314 causes the aft rail 306 to deflect in a forward direction 318. Generally speaking, directions 316, 318 are parallel to an engine axis. Without additional support, the deflection of the forward rail 304 in the aftward direction 316 and the aft rail 306 in the forward direction 318 may be of a magnitude that can cause high stresses in the vane assembly 300, may limit overall structural capability, and may negatively impact part life.

Figure 4:
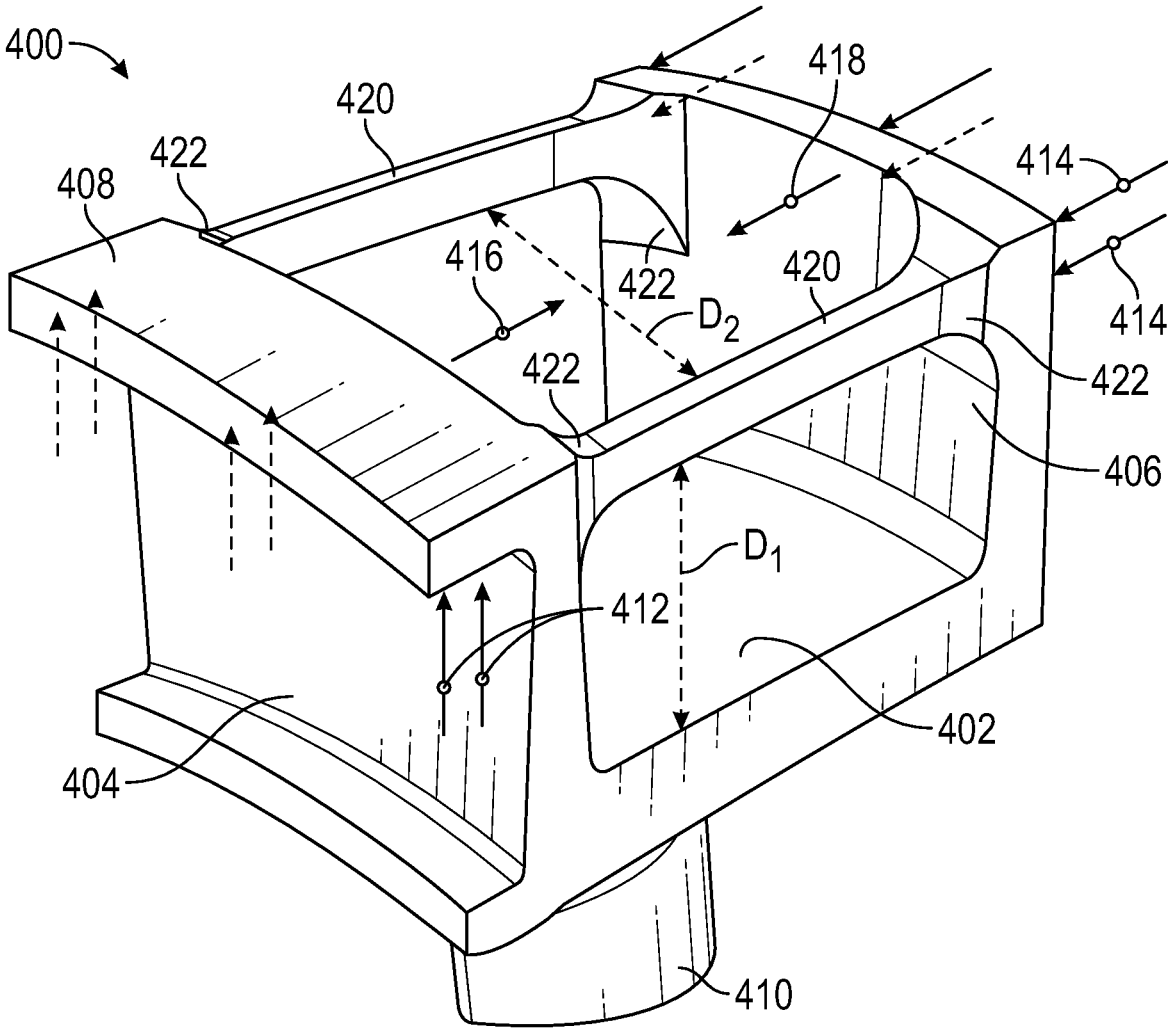
FIG. 4 is a schematic illustration of a vane assembly in accordance with an embodiment of the present disclosure.

Referring now to FIG. 4, a schematic illustration of a vane assembly 400 in accordance with an embodiment of the present disclosure is shown. FIG. 4 illustrates a high pressure turbine vane outer diameter section of the vane assembly 400. The vane assembly 400 includes a platform 402 with a forward rail 404 and an aft rail 406. The forward rail 404 includes a forward hook 408 for engaging with a portion of a turbine case. An airfoil 410 extends radially inward from the platform 402. The vane assembly 400 is constrained in a radial direction via interfacing hardware that exposes the forward hook 408 to a forward distributed reaction force 412. The vane assembly 400 is constrained in the axial direction via interfacing hardware that exposes the aft rail 406 to an aft distributed reaction force 414. The forward distributed reaction force 412 tends to cause the forward rail 404 to deflect in an aftward direction 416 and the aft distributed reaction force 414 tends to cause the aft rail 406 to deflect in a forward direction 418.

As shown, the vane assembly 400 includes support beams 420. The support beams 420 are structural elements that extend between the forward rail 404 and the aft rail 406 at an outer diameter or end opposite the platform of the vane assembly. That is, the support beams 420 are arranged at the maximal end or extent of the rails 404, 406 and away from the platform 402. The support beams 420, which connect the forward rail 404 and the aft rail 406, are arranged generally extending in a forward/aftward direction (416, 418), but are skewed or angled relative to the forward/aftward directions (416, 418) which are parallel to an engine axis. The support beams 420 are configured to reduce the deflections of the forward rail 404 and the aft rail 406 in the aftward direction 416 and the forward direction 418, respectively. This reduction in deflections can reduce peak stresses in the part, increase overall structural capability, and positively impact part life.

As illustrated in FIG. 4, the support beams 420 are discrete structures that extend in the forward-aft direction between the rails 404, 406. In directions normal to the forward-aft direction (e.g., radially inward toward the platform 402 ("$D_1$") and/or in a direction between the support beams 420 ("$D_2$")) are voids or empty space. This allows for reduced weight of the vane assembly 400 while improving structural integrity and part life. The support beams 420 may include filleted or chamfered surfaces 422 at the points where the support beams 420 connect to or attach to the respective rails 404, 406.

In some embodiments, such as shown in FIG. 4, the support beams 420 may be integrally formed with the vane assembly 400. That is, the support beams 420 may be formed during a casting or machining process such that the support beams 420 are formed from the same material as the rest of the vane assembly 400. In other embodiments, the support beams 420 may be secured to the rails 404, 406 by bonding, welding, brazing, adhesives, and the like. In still other embodiments, fasteners may be used, such that a fastener passes through a respective rail 404, 406 to engage with and secure the support beams 420 in place. In some embodiments, the support beams 420 may be formed from materials different from the vane assembly 400. For example, because the support beams 420 are arranged away from the platform 402, the support beams 420 may not be subject to the high temperatures present along the platform 402. As such, the material of the support beams 420 may be selected for weight or strength purposes but may not require high temperature materials to be selected, in some embodiments.

The support beams are arranged to reduce deflections of the rails and thus reduce mechanical fatigue caused by such deflections. By arranging the support beams at a position or end of the rails away from the platform, maximal support may be provided, in contrast to a configuration that includes support at the end/location of the platform. Moreover, such arrangement can minimize the size and dimensions of the support beams by reducing the amount of material at the location of the platform itself.

Figure 5:
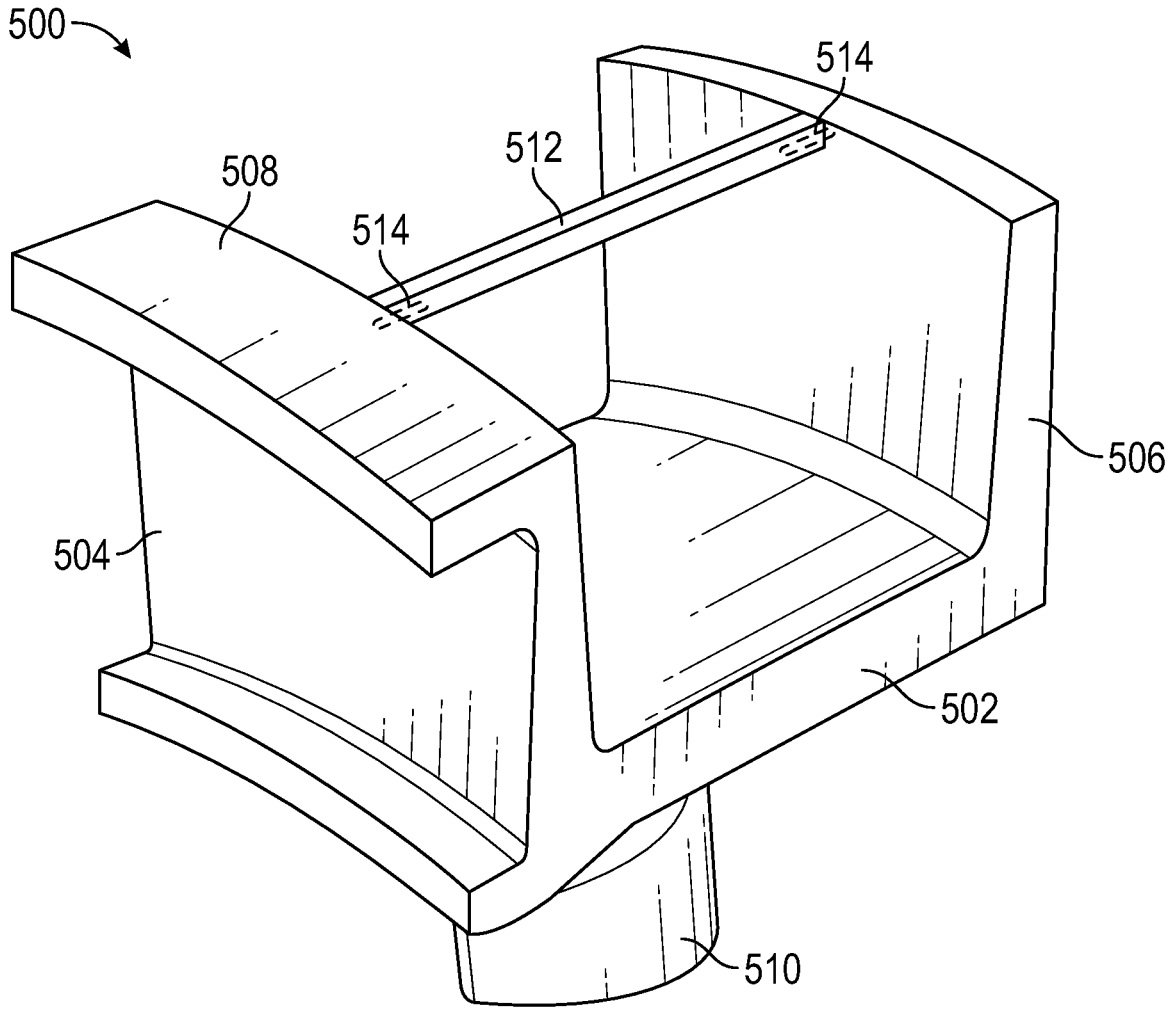
FIG. 5 is a schematic illustration of a vane assembly in accordance with an embodiment of the present disclosure.

Although shown in FIG. 4 with only two support beams, those of skill in the art will appreciate that other configurations are possible without departing from the scope of the present disclosure. For example, referring to FIG. 5, a schematic illustration of a of a vane assembly 500 in accordance with an embodiment of the present disclosure is shown. FIG. 5 illustrates a high pressure turbine vane outer diameter section of the vane assembly 500. The vane assembly 500 includes a platform 502 with a forward rail 504 and an aft rail 506. The forward rail 504 includes a forward hook 508 for engaging with a portion of a turbine case. An airfoil 510 extends radially inward from the platform 502. The vane assembly 500, in this embodiment, includes a single support beam 512. The support beam 512 is a structural element that extends between the forward rail 504 and the aft rail 506 at an outer diameter of the vane assembly. The support beam 512 extends between the forward rail 504 and the aft rail 506. The support beam 512 is configured to reduce deflections of the forward rail 504 and the aft rail 506, as described above. This reduction in deflection can reduce peak stresses in the part, increase overall structural capability, and positively impact part life.

In FIG. 5, the support beam 512 does not include the filleted or chamfered surfaces where the support beam 512 joins with the rails 504, 506. In contrast, in this embodiment, fasteners 514 are used which pass through the rails 504, 506 and fixedly attach to and retain the support beam 512 in place between the rails 504, 506. It will be appreciated that other types of joining/fastening mechanisms may be employed without departing from the scope of the present disclosure. For example, a support beam may be attached by welding, brazing, adhesives, bonding, integral casting or molding, additive manufacturing, or the like.

It will be appreciated that a greater number of support beams may be employed in various configurations in accordance with the present disclosure. For example, three or more support beams may be incorporated into vane assemblies without departing from the scope of the present disclosure. Further, the support beams disclosed herein may be applied to both inner diameter platforms/vane assemblies (e.g., inner diameter platform 216 of FIG. 2) and outer diameter platforms/vane assemblies (e.g., outer diameter platform 214 of FIG. 2).

Figure 6A:
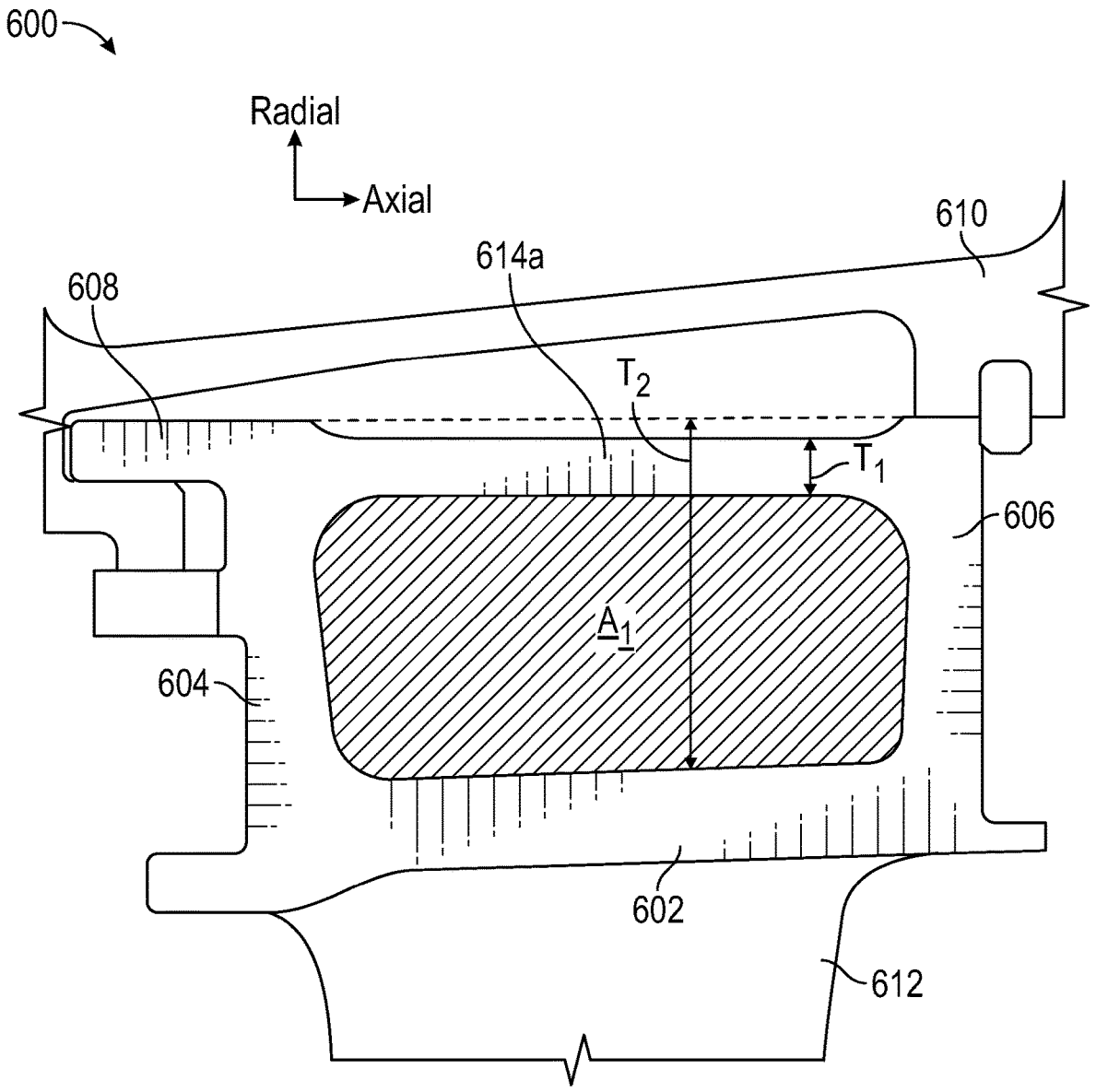
FIG. 6A is a side view illustration of a vane assembly in accordance with an embodiment of the present disclosure.
Figure 6B:
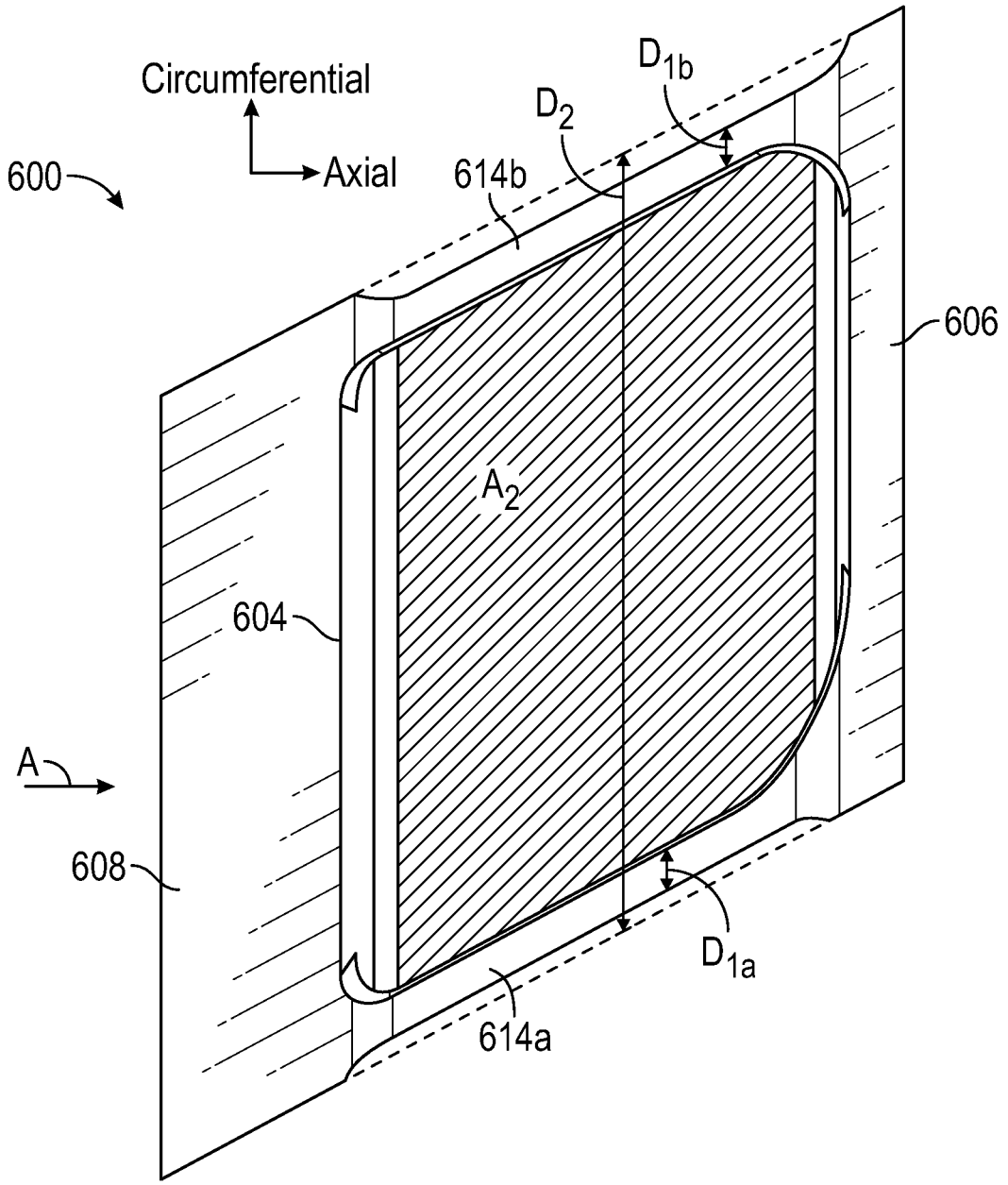
FIG. 6B is a radially inward view of the vane assembly of FIG. 6A.

Turning now to FIGS. 6A-6B, schematic illustrations of a vane assembly 600 are shown. FIG. 6A is a side view illustration of the vane assembly 600 as installed within a gas turbine engine and FIG. 6B is a top down (or radially inward) view of the vane assembly 600. As shown in FIG. 6A, the vane assembly 600 includes a platform 602 with a forward rail 604 and an aft rail 606. The forward rail 604 includes a forward hook 608 for engaging with a portion of a turbine case 610. An airfoil 612 extends radially inward from the platform 602.

The vane assembly 600, in this embodiment, includes two support beam 614*a*, 614*b*. The support beams 614*a*, 614*b* are structural elements that extend between the forward rail 604 and the aft rail 606 at an outer diameter of the vane assembly 600. The support beams 614*a*, 614*b* are sized and shaped to maximize structural support while minimizing impact to cooling and weight. As such, as shown in FIG. 6A, the support beam 614*a* has a thickness $T_1$ in a radial direction that is a percentage of a total radial extent $T_2$ of the vane assembly 600. For example, in some embodiments, the thickness $T_1$ of the support beam 614*a* may be 40% or less of the total radial extent $T_2$ of the vane assembly 600. This configuration enables a cooling flow to flow through and along the vane assembly 600 to provide cooling to the platform 602 and the rails 604, 606. The cooling flow may be in a circumferential direction (e.g., into/out of the page of FIG. 6A). The circumferential cooling flow area is indicated by area $A_1$ in FIG. 6A (e.g., a void or unobstructed area/space). Accordingly, or stated another way, the support beams 614*a*, 614*b* may only block 30% or less of the circumferential direction, allowing for cooling flow in the circumferential direction to be substantially unimpeded. Although described as covering 40% or less of the total radial extent $T_2$, in some embodiments, the support beams 614*a*, 614*b* may cover 30% or less, 20% or less, 15% or less, 10% or less, or other percentage of the total radial extent $T_2$ of the vane assembly 600.

As shown in FIG. 6B, the support beams 614*a*, 614*b* have a thickness $D_{1a}$, $D_{1b}$ in a circumferential direction that is a percentage of a total circumferential extent $D_2$ of the vane assembly 600. For example, in some embodiments, the combined thickness $D_{1a}+D_{1b}$ of the support beams 614*a*, 614*b* may be 30% or less of the total circumferential extent $D_2$ of the vane assembly 600, with each support beam 614*a*, 614*b* being substantially the same and thus occupying half of the combined thickness $D_{1a}+D_{1b}$ of the support beams 614*a*, 614*b*. This configuration enables a cooling flow to flow into the vane assembly 600 in a radial direction to provide cooling to the platform 602 and the rails 604, 606. A cooling flow supply may be in a radial direction (e.g., into/out of the page of FIG. 6B). The radial cooling flow area is indicated by area $A_2$ in FIG. 6B (e.g., a void or unobstructed area/space). Accordingly, or stated another way, the support beams 614*a*, 614*b* may only block 30% or less of the radial direction, allowing for cooling flow in the radial direction to be substantially unimpeded. Although described as covering 30% or less of the total circumferential extent $D_2$, in some embodiments, the support beams 614*a*, 614*b* may cover 20% or less, 15% or less, 10% or less, 6% or less, or other percentage of the total circumferential extent $D_2$ of the vane assembly 600. Furthermore, even with additional support beams added (e.g., between the illustrated support beams 614*a*, 614*b*), the total combined circumferential blockage of the support beams may be 30% or less in combination.

As illustratively shown in FIGS. 6A-6B, the support beams 614*a*, 614*b* may have substantially square or rectangular cross-section geometry. In other embodiments, the support beams may have circular cross-sectional geometries, or other geometric shape. It will be appreciated from the illustrative embodiments, that the support beams may have substantially uniform cross-section geometry along the axial (forward-aft) direction, except where the support beams join or are attached to the forward and aft rails. Further, although referred to as support beams, it will be appreciated that the support beams may not be exactly at the outer diameter extent, but rather may be set slightly radially inward from the maximum outer diameter point of the respective rails (e.g., as shown in FIG. 6A). Similarly, in the circumferential direction, the support beams may not be exactly at the outer edge extent (e.g., as shown in FIG. 6B).

The terms "substantially" and "about" are intended to include the degree of error associated with measurement of the particular quantity based upon the equipment available at the time of filing the application. For example, "about" can include a range of ±8% or 5%, or 2% of a given value. Similarly, "substantially" can include deviations of a measurement or value within known errors and variation.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vane assembly comprising:

a platform;

an airfoil extending from a first side of the platform;

a forward rail extending from a second side of the platform and arranged along a forward side of the platform;

an aft rail extending from the second side of the platform and arranged along an aft side of the platform;

at least one support beam extending in a forward-aft direction between the forward rail and the aft rail and separated from the platform by a first distance, wherein the at least one support beam has a thickness in a radial direction of 40% or less of a total radial extent from the platform to an outer diameter edge of at least one of the forward rail and the aft rail, and wherein the at least one support beam has a thickness in a circumferential direction of 30% or less of a total circumferential extent of vane assembly.

2. The vane assembly of claim 1, wherein the at least one support beam comprises a first support beam and a second support beam separated by a void in a direction between the first and second support beams.

3. The vane assembly of claim 1, wherein the at least one support beam is formed from a material different from the forward rail and the aft rail.

4. The vane assembly of claim 1, wherein the at least one support beam is formed from a material that is the same as that of the forward rail and the aft rail.

5. The vane assembly of claim 1, wherein the at least one support beam is integrally formed with each of the forward rail and the aft rail.

6. The vane assembly of claim 1, wherein the at least one support beam includes filleted surfaces at locations where the at least one support beam connects to at least one of the forward rail and the aft rail.

7. The vane assembly of claim 1, wherein the at least one support beam is welded to each of the forward rail and the aft rail.

8. The vane assembly of claim 1, wherein the at least one support beam is brazed to each of the forward rail and the aft rail.

9. The vane assembly of claim 1, wherein the forward rail includes a forward hook configured to engage with a portion of a turbine case.

10. The vane assembly of claim 1, wherein the at least one support beam comprises at least two support beams that occupy a combined thickness in the radial direction of 40% or less of the total radial extent from the platform to an outer diameter edge of at least one of the forward rail and the aft rail and a combined thickness in the circumferential direction of 30% or less of the total circumferential extent of vane assembly.

11. A gas turbine engine comprising:

a turbine case; and a vane assembly comprising:

a platform;

an airfoil extending from a first side of the platform;

a forward rail extending from a second side of the platform and arranged along a forward side of the platform;

an aft rail extending from the second side of the platform and arranged along an aft side of the platform;

at least one support beam extending in a forward-aft direction between the forward rail and the aft rail and separated from the platform by a first distance, wherein the at least one support beam has a thickness in a radial direction of 40% or less of a total radial extent from the platform to an outer diameter edge of at least one of the forward rail and the aft rail, and wherein the at least one support beam has a thickness in a circumferential direction of 30% or less of a total circumferential extent of vane assembly.

12. The gas turbine engine of claim 11, wherein the at least one support beam comprises a first support beam and a second support beam separated by a void in a direction between the first and second support beams.

13. The gas turbine engine of claim 11, wherein the at least one support beam is formed from a material different from the forward rail and the aft rail.

14. The gas turbine engine of claim 11, wherein the at least one support beam is formed from a material that is the same as that of the forward rail and the aft rail.

15. The gas turbine engine of claim 11, wherein the at least one support beam is integrally formed with each of the forward rail and the aft rail.

16. The gas turbine engine of claim 11, wherein the at least one support beam includes filleted surfaces at locations where the at least one support beam connects to at least one of the forward rail and the aft rail.

17. The gas turbine engine of claim 11, wherein the at least one support beam is welded to each of the forward rail and the aft rail.

18. The gas turbine engine of claim 11, wherein the at least one support beam is brazed to each of the forward rail and the aft rail.

19. The gas turbine engine of claim 11, wherein the forward rail includes a forward hook configured to engage with a portion of the turbine case.

20. The gas turbine engine of claim 11, wherein the at least one support beam comprises at least two support beams that occupy a combined thickness in the radial direction of 40% or less of the total radial extent from the platform to an outer diameter edge of at least one of the forward rail and the aft rail and a combined thickness in the circumferential direction of 30% or less of the total circumferential extent of vane assembly.

* * * * *